US007059581B2

(12) United States Patent
Invernizzi

(10) Patent No.: US 7,059,581 B2
(45) Date of Patent: Jun. 13, 2006

(54) VALVE AND A GAS BURNER

(75) Inventor: Gianmario Invernizzi, Lecco (IT)

(73) Assignee: Connemara Innovation Limited, Barna (IE)

( * ) Notice: Subject to any disclaimer, the term of this patent is extended or adjusted under 35 U.S.C. 154(b) by 198 days.

(21) Appl. No.: 10/481,329

(22) PCT Filed: Jun. 21, 2002

(86) PCT No.: PCT/IE02/00082

§ 371 (c)(1),
(2), (4) Date: Dec. 22, 2003

(87) PCT Pub. No.: WO03/001115

PCT Pub. Date: Jan. 3, 2003

(65) Prior Publication Data

US 2004/0183042 A1 Sep. 23, 2004

(30) Foreign Application Priority Data

Jun. 21, 2001 (IE) ..... S2001/0574
Oct. 10, 2001 (IE) ..... S2001/0897

(51) Int. Cl.
*F16K 31/04* (2006.01)

(52) U.S. Cl. ..... 251/129.12; 137/870; 251/337

(58) Field of Classification Search ..... 251/129.11, 251/129.12, 129.04, 129.01, 337, 285; 126/52, 126/39 BA, 39 E, 39; 137/870
See application file for complete search history.

(56) References Cited

U.S. PATENT DOCUMENTS 3,392,740 A * 7/1968 Fleer ..... 137/870
5,351,935 A * 10/1994 Miyoshi et al. ..... 251/129.11
5,429,111 A * 7/1995 Akamatsu ..... 126/52
5,785,511 A * 7/1998 Shah ..... 251/229
5,979,484 A * 11/1999 Grando et al. ..... 251/129.11

* cited by examiner

*Primary Examiner*—John Bastianelli
(74) *Attorney, Agent, or Firm*—Sughrue Mion, PLLC

(57) ABSTRACT

A valve for supplying fuel gas to a fuel gas appliance comprises a valve housing which defines a valve chamber within which a main carrier member is axially moveable. The main carrier carries a primary and a secondary valving member for co-operating respectively with a primary and a secondary valve seat. A pilot fluid outlet supplies fuel gas to a pilot jet. A stepper motor comprising a rotor and four magnetic coils urges the main carrier between a fully open and closed position. An electro-magnetic coil located in the main carrier magnetically couples primary and secondary end plates to the main carrier. Magnetic decoupling of the primary and secondary end plates from the main carrier permits the main carrier to be urged into the closed position by primary compression springs. The drive transmission comprises a drive shaft from the rotor of the stepper motor and a drive spindle.

13 Claims, 8 Drawing Sheets

VALVE AND A GAS BURNER

This is a National Stage entry of Application No. PCT/IE02/00082 filed Jun. 21, 2002; the disclosure of which is incorporated herein by reference.

BACKGROUND OF THE INVENTION

The present invention relates to a valve, and in particular, though not limited to a flow control valve which is particularly suitable for controlling the flow of fuel gas to a gas powered appliance. The invention also relates to a gas burner, and to a gas burner incorporating the valve.

Flow control valves which are typically used for controlling the supply of fuel gas to a gas powered appliance, for example, a gas powered heater, a gas powered oven, a gas powered hob or the like, may be manually operated or may be motor operated by, for example, a servo-motor, and in some cases may be operated by a solenoid coil. Typically such valves comprise a valve housing which define a hollow interior valve chamber. An inlet port is provided to the valve chamber, while an outlet port is provided from the valve chamber. A valve seat is formed within the valve chamber between the inlet and the outlet ports, and defines a fluid passageway between the respective inlet and outlet ports. A valving member located within the valve chamber co-operates with the valve seat for closing the communicating passageway for in turn closing the valve. In a manually operated valve the valving member is manually urged into and out of engagement with the valve seat by a manually operable mechanism connected to the valving member for closing and opening the fluid passageway. In the case of motor or solenoid operated valves the valving member is urged into and out of engagement with the valve seat by a servo-motor or a solenoid. An urging means, typically, a compression spring is provided for urging the valving member into engagement with the valve seat in the event of an emergency, and it is necessary to isolate the appliance from the gas supply. Various arrangements are provided for disengaging the valving member from the manual drive mechanism, the servo-motor or the solenoid in order that the valving member can be urged by the compression spring into engagement with the valve seat independently of the various drive mechanisms. However, in general, such arrangements for disengaging the valving member from the drive mechanism suffer from a number of disadvantages. Firstly, in many cases they are slow to react, and secondly, in general, it is difficult if not impossible to establish the absolute position of the valving member relative to the valve seat. This is a serious disadvantage, since it prevents accurate and precise control of the flow of fuel gas through the valve, and in general, setting of the flow of fuel gas through the valve to a desired flow rate can only be achieved by trial and error.

There is therefore a need for a valve which permits the absolute position of a valving member in a valve to be established, whether the valving member is disengageable from a drive means for operating the valving member or not, and additionally, there is a need for a gas burner, and a gas burner incorporating such a valve.

SUMMARY OF THE INVENTION

The present invention is directed towards providing such a valve and a gas burner.

According to the invention there is provided a valve comprising a housing defining a valve chamber and a valve seat in the valve chamber, a fluid inlet to the valve chamber, and a fluid outlet from the valve chamber, the fluid outlet communicating with the fluid inlet through a fluid passageway defined by the valve seat, a valving member co-operable with the valve seat for throttling fluid flow through the fluid passageway, a drive means coupled to the valving member for progressively operating the valving member between a closed position with the valving member engaging the valve seat for closing the fluid passageway, and a fully open position with the valving member spaced apart from the valve seat for opening the fluid passageway, wherein a synchronizing means is provided for synchronizing the drive means with the valving member, so that the absolute amount of throttling of the fluid through the fluid passageway by the valving member is directly determined by the amount of drive imparted to the valving member by the drive means.

In one embodiment of the invention the synchronizing means determines a datum condition of the drive means corresponding to a known position of the valving member. Preferably, the synchronizing means determines the datum condition of the drive means corresponding to the valving member being in one of the fully open position and the fully closed position. Advantageously, the synchronizing means determines the datum condition of the drive means corresponding to the valving member being in the fully open position.

In one embodiment of the invention the drive means operates the valving member through a drive transmission means, and the synchronizing means is located in the drive transmission means. Preferably, the drive transmission means comprises a pair of co-operating drive transmission elements, and the synchronizing means determines the datum condition of the drive means when the respective drive transmission elements are in a predetermined relationship relative to each other corresponding to the known position of the valving member. Advantageously, the drive transmission elements co-operate with each other for converting rotational drive from the drive means to linear drive for operating the valving member with rectilinear motion between the closed position and the fully open position. Ideally, the predetermined relationship of the respective drive transmission elements at which the datum condition of the drive means is determined is a relationship whereby the respective drive transmission elements are disengaged one from the other. Preferably, the disengaged condition of the respective drive transmission elements at which the datum condition of the drive means is determined is a disengaged condition in which the respective drive transmission elements are about to re-engage.

In another embodiment of the invention a main urging means is provided for urging the respective drive transmission elements into re-engagement with each other when the drive transmission elements are disengaged one from the other in the predetermined relationship. Preferably, the main urging means urges the drive transmission elements into re-engagement with each other so that when the drive means commences to impart drive to one of the drive transmission elements after the datum condition has been determined, the respective drive transmission elements engage each other for transmitting drive to the valving member.

In another embodiment of the invention one of the drive transmission elements is a rotatably mounted drive shaft which is rotatably driven by the drive means, the drive shaft having one of an internal and an external screw thread, and the other drive transmission element is a linearly moveable drive spindle having the other of the internal and the external screw thread co-operating with the screw thread on the drive shaft so that rotation of the drive shaft in one rotational direction urges the drive spindle in one linear direction, and rotation of the drive shaft in the other rotational direction urges the drive spindle in the opposite linear direction. Preferably, the screw threads of the respective drive transmission elements are disengageable when the drive spindle is in a position corresponding to the valving member being in the fully open position. Advantageously, the drive shaft comprises the internal screw thread.

In another embodiment of the invention the drive means comprises an electrically powered drive motor. Preferably, the electrically powered drive motor is a stepper motor. Advantageously, the stepper motor comprises a rotor and a plurality of independently powered electromagnetic coils, so that the angular position and the direction of motion of the rotor can be determined by selectively powering the coils. Advantageously, the stepper motor comprises four independently powered electro-magnetic coils located at 90° intervals around a central rotational axis of the rotor.

In one embodiment of the invention the drive shaft of the drive transmission means is provided by a drive shaft of the drive motor.

In a further embodiment of the invention the housing defines a main central longitudinally extending axis, and the valving member is moveable axially along the main central axis between the fully open and the closed position. Preferably, the rotational axis of the drive shaft coincides with the main central axis defined by the housing.

In one embodiment of the invention the valving member is releasably coupleable to the drive means. Preferably, a primary urging means is provided for urging the valving member into the closed position when the valving member is decoupled from the drive means. Advantageously, the valving member is magnetically coupled to the drive means.

In another embodiment of the invention an intermediate valve member is located adjacent the valve seat and is moveable relative thereto, the intermediate valve member being engageable with and moveable with the valving member during movement of the valving member when the valving member is moving in close proximity to the valve seat, and being co-operable with a portion of the housing so that as the intermediate valve member is engaged with and is moving with the valving member the flow rate of fluid through the fluid passageway is progressively altered by the co-operating action of the intermediate valve member and the housing.

In another embodiment of the invention the valve seat is moveable within the valve chamber relative to the valving member in response to fluid pressure at the fluid inlet for regulating the flow of fluid through the valve in response to the fluid pressure fluctuation at the fluid inlet.

In a further embodiment of the invention the valve is incorporated in a manifold having a manifold housing, and the manifold housing is integrally formed with the housing of the valve. Preferably, a plurality of spaced apart jet outlet ports are provided from the manifold housing. Advantageously, the manifold housing extends from the valve outlet.

In one embodiment of the invention the manifold housing extends axially from the valve housing in a general axial direction relative to the main central axis of the valve.

In another embodiment of the invention the manifold housing defines a longitudinally extending central axis, and the central axis of the manifold housing coincides with the central axis of the valve.

Preferably, the jet outlet ports are spaced apart in an axial direction relative to the central axis of the manifold housing.

Advantageously, the valve housing and the manifold housing are formed in one piece from a tubular member.

In one embodiment of the invention the valve housing is formed by shaping the tubular member.

In another embodiment of the invention the valve housing and the manifold housing are machined from one single piece of material.

Additionally the invention provides a valve comprising a housing defining a valve chamber and a valve seat in the valve chamber, a fluid inlet to the valve chamber, and a fluid outlet from the valve chamber, the fluid outlet communicating with the fluid inlet through a fluid passageway defined by the valve seat, a valving member co-operable with the valve seat for throttling fluid flow through the fluid passageway, a drive means magnetically coupleable with the valving member for progressively operating the valving member when the valving member is magnetically coupled to the drive means between a closed position with the valving member engaging the valve seat for closing the fluid passageway, and a fully open position with the valving member spaced apart from the valve seat for opening the fluid passageway, a primary urging means for urging the valving member into the closed position when the valving member is magnetically decoupled from the drive means, wherein a synchronizing means is provided for synchronizing the drive means with the valving member, so that when the drive means is magnetically coupled to the valving member the absolute amount of throttling of the fluid through the fluid passageway by the valving member is directly determined by the amount of drive imparted to the valving member by the drive means.

Further the invention provides a valve comprising a housing defining a valve chamber, and a valve seat in the valve chamber, a fluid inlet to the valve chamber, and a fluid outlet from the valve chamber, the fluid outlet communicating with the fluid inlet through a fluid passageway defined by the valve seat, a valving member co-operable with the valve seat and being moveable between a closed position in engagement with the valve seat for closing the fluid passageway, and a fully open position spaced apart from the valve seat for permitting fluid flow through the fluid passageway, wherein an intermediate valve member is located adjacent the valve seat and is moveable relative thereto, the intermediate valve member being engageable with and moveable with the valving member during movement of the valving member when the valving member is moving in close proximity to the valve seat, and being co-operable with a portion of the housing so that as the intermediate valve member is engaged with and is moving with the valving member the flow rate of fluid through the fluid passageway is progressively altered by the co-operating action of the intermediate valve member and the housing.

In one embodiment of the invention the intermediate valve member is moveable through a predetermined distance relative to the valve seat, which is less than the distance through which the valving member is moveable relative to the valve seat between the fully open position and the closed position. Preferably, the predetermined distance through which the intermediate valve member is moveable relative to the valve seat is significantly less than the distance through which the valving member is moveable relative to the valve seat between the fully open position and the closed position.

In one embodiment of the invention the intermediate valve member is located in and is moveable in the fluid passageway.

In another embodiment of the invention the portion of the housing with which the intermediate valve member is co-operable is the valve seat.

In another embodiment of the invention at least one fluid accommodating opening is provided through the intermediate valve member, which when the intermediate valve member is engaged by the valving member communicates the fluid inlet with the fluid outlet, and as the valving member is urged towards the closed position the at least one fluid accommodating opening co-operates with the portion of the housing for progressively reducing the flow of fluid through the fluid passageway. Preferably, the intermediate valve member co-operates with the portion of the housing for progressively closing each fluid accommodating opening as the valving member is urged towards the closed position.

In one embodiment of the invention the intermediate valve member is of annular shape having a side wall terminating in a radial abutment face for abutting the valving member. Preferably, each fluid accommodating opening extends through the side wall of the intermediate valve member for co-operating with the valve seat so that as the intermediate valve member moves relative to the valve seat the effective area of each fluid accommodating opening is progressively altered for progressively altering the flow of fluid therethrough. Advantageously, a plurality of fluid accommodating openings are located at spaced apart intervals circumferentially around the side wall of the intermediate valve member. Ideally, each fluid accommodating opening is formed by an elongated slot which extends in a direction parallel to the direction of movement of the intermediate valve member. Preferably, each elongated fluid accommodating slot extends from the radial abutment face.

In one embodiment of the invention the transverse width of each fluid accommodating slot progressively increases from the radial abutment face.

In another embodiment of the invention the intermediate valve member is moveable in a general axial direction in the fluid passageway.

Preferably, the intermediate valve member defines a central axis. Advantageously, the central axis of the intermediate valve member coincides with a main central axis of the valve defined by the housing thereof.

The invention also provides a valve comprising a housing defining a valve chamber, and a valve seat in the valve chamber, a fluid inlet to the valve chamber, and a fluid outlet from the valve chamber, the fluid outlet communicating with the fluid inlet through a fluid passageway defined by the valve seat, a valving member co-operable with the valve seat and being moveable between a closed position in engagement with the valve seat for closing the fluid passageway, and a fully open position spaced apart from the valve seat for permitting fluid flow through the fluid passageway, wherein the valve seat is moveable within the valve chamber relative to the valving member in response to fluid pressure at the fluid inlet for regulating the flow of fluid through the valve in response to the fluid pressure fluctuation at the fluid inlet.

Preferably, the valve seat is moveable within the valve chamber in response to the fluctuation in fluid pressure at the fluid inlet for maintaining the flow of fluid through the valve substantially independent of fluid pressure fluctuation at the fluid inlet. Advantageously, the valving member and the valve seat define an annular opening through which fluid is accommodated through the valve chamber from the fluid inlet to the fluid outlet, and movement of the valve seat relative to the valving member in response to fluid pressure fluctuation at the fluid inlet varies the area of the annular opening.

In one embodiment of the invention the valve seat is formed on an intermediate valve member, the intermediate valve member defining the fluid passageway and being slideably moveable in the valve chamber. Preferably, the intermediate valve member is moveable axially within the valve chamber for moving the valve seat with rectilinear motion relative to the valve member. Advantageously, the valving member and the intermediate valve member are moveable relative to each other along a common axis.

In one embodiment of the invention the intermediate valve member is carried on a membrane extending around the intermediate valve member and between the intermediate valve member and the housing, the membrane defining with the housing and the intermediate valve member a control chamber, and a fluid bleed passageway communicating the control chamber with the fluid inlet so that pressure in the control chamber fluctuates with the fluid pressure at the fluid inlet, the intermediate valve member being moveable in response to pressure fluctuation in the control chamber. Preferably, a supplementary urging means is provided for urging the intermediate valve member away from the valving member, and the intermediate valve member is urgeable towards the valving member in response to an increase in fluid pressure at the fluid inlet.

In one embodiment of the invention the valve is incorporated in a manifold having a manifold housing, and the manifold housing is integrally formed with the housing of the valve.

Additionally the invention provides a gas burner comprising a manifold having a fuel gas inlet port and at least one jet outlet port, and an isolating valve located in the manifold for isolating the at least one jet outlet port from the fuel gas inlet port.

In one embodiment of the invention the isolating valve is located adjacent the inlet port. Preferably, a portion of the manifold adjacent the inlet port defines a housing of the valve. Advantageously, the portion of the manifold forming the valve housing defines a valve chamber and a valve seat within the valve housing.

In another embodiment of the invention a valving member is co-operable with the valve seat for selectively isolating the at least one jet outlet port from the inlet port.

In a further embodiment of the invention the manifold and the portion of the manifold which forms the valve housing are formed in one piece. Preferably, the manifold and the portion of the manifold which forms the valve housing is formed from the same piece of material. Advantageously, the manifold and the portion of the manifold which forms the valve housing is formed from one piece of material by machining.

Ideally, the manifold and the portion of the manifold which forms the valve housing is formed from a single tubular piece of material which is shaped by turning. Preferably, the manifold is an elongated manifold and comprises a plurality of jet outlet ports spaced apart longitudinally along the manifold.

The advantages of the invention are many. By virtue of the fact that a datum condition of the drive means can be determined relative to a known position of the valving member, the absolute position of the valving member in the valve chamber can be readily determined. This, thus, permits accurate and precise control of the flow of fluid through the valve.

The fact that the absolute position of the valving member in the valve chamber can be readily determined is a particularly important advantage in valves in which the valving member is decoupleable from the drive means, in that on recoupling of the valving member with the drive means, the absolute position of the valving member in the valve chamber can be readily determined, and this, thus, permits the flow rate of fuel through the valve to be readily and accurately set at any desired flow rate, and permits that desired flow rate to be readily established.

The provision of the drive transmission means in the form of a pair of interengageable screw threads which are disengageable for determining the datum condition of the drive means further facilitates the determination of the datum condition of the drive means relative to the valving member.

By providing the intermediate valve member, relatively accurate control of fluid flow at relatively low flow rates through the valve can be achieved. Furthermore, by providing the valve seat as being moveable relative to the valving member, and being moveable in response to fluid pressure fluctuations at the fluid inlet, the flow rate of fluid through the valve is substantially independent of pressure fluctuations in the fluid at the fluid inlet.

By releasably magnetically coupling the valving member to the drive means facilitates rapid operation of the valving member into engagement with the valve seat for closing the valve.

The provision of the gas burner in the form of a manifold incorporating a valve, and in particular the valve according to the invention in a single integral one piece form provides the particularly important advantage that the risk of fuel gas leaks is minimised.

BRIEF DESCRIPTION OF THE DRAWINGS

The invention will be more clearly understood from the following description of some preferred embodiments thereof, which are given by way of example only, with reference to the accompanying drawings, in which.

DETAILED DESCRIPTION OF THE INVENTION

Figure 1:
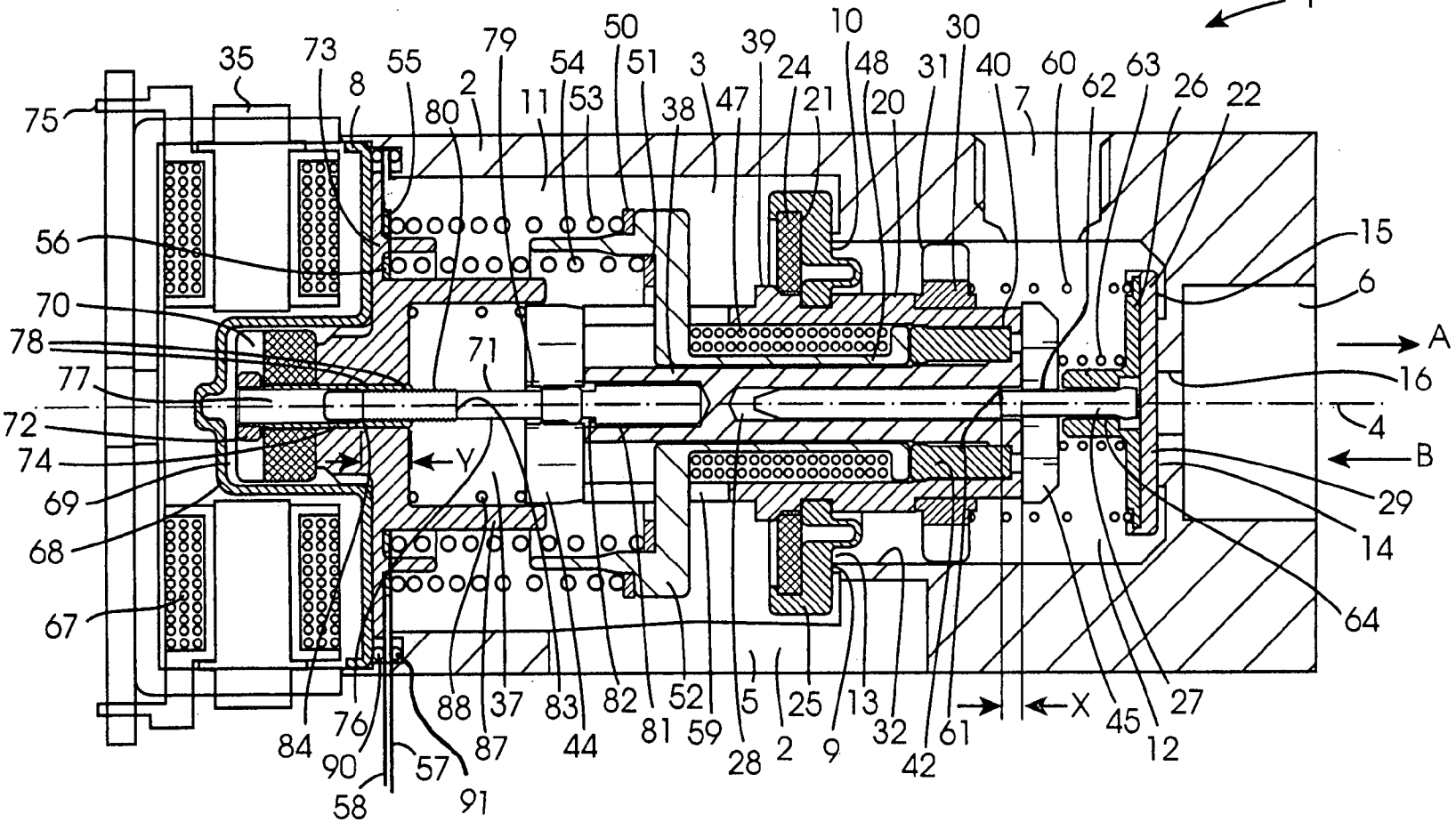
FIG. 1 is a cross-sectional side elevational view of a valve according to the invention.

Referring to the drawings and initially to FIGS. 1 to 12 thereof, there is illustrated a valve according to the invention indicated generally by the reference numeral 1, which is particularly suitable for controlling the flow of fuel gas to a fuel gas burner, for example, a burner of a gas fired central heating boiler, a burner of a gas fired cooking oven or the like. The valve 1 comprises a housing, namely, a main housing 2 of circular transverse cross-section, which defines a main valve chamber 3 of circular transverse cross-section. The main valve chamber 3 defines a geometric centrally extending main central axis 4, which extends through the valve housing 2.

A fluid inlet 5 accommodates fluid, typically fuel gas, into the main valve chamber 3, and a pair of fluid outlets, namely, a main fluid outlet 6 and a pilot fluid outlet 7 accommodate fuel gas from the main valve chamber 3. Typically, the main fluid outlet 6 would deliver fuel gas to a burner or the like, while fuel gas would be delivered to a pilot light jet of the burner from the pilot outlet 7. An end cap 8 which will be described in detail below is in sealable engagement with the main housing 2, and sealably closes the main valve chamber 3.

An annular ring 9 extending from the main housing 2 around and into the main valve chamber 3 forms a primary valve seat 10 which divides the valve chamber into an upstream chamber 11 and a downstream chamber 12. The primary valve seat 10 defines a primary fluid passageway 13 communicating the downstream chamber 12 with the upstream chamber 11. An annular ring 14 extending from the main housing 2 into the downstream chamber 12 forms a secondary valve seat 15 which defines a secondary fluid passageway 16 communicating the main fluid outlet 6 with the downstream chamber 12.

A main carrier 20 which is slideable axially in the directions of the arrows A and B in the main valve chamber 3 carries a primary valving member 21 and a secondary valving member 22. The primary valving member 21 comprises an annular carrier 24, which extends around the main carrier 20, and supports an annular primary seal 25 which sealably engages the main carrier 20, and which is selectively sealably engageable with the primary valve seat 10 for selectively isolating the downstream chamber 12 from the upstream chamber 11. The secondary valving member 22 comprises a carrier disc 26 which is in turn carried on a carrier spindle 27 which is slideably engageable in a bore 28 in the main carrier 20 as will be described below. A secondary sealing disc 29, which is carried on the carrier disc 26 is selectively sealably engageable with the secondary valve seat 15 for selectively isolating the main fluid outlet 6 from the downstream chamber 12. A guide ring 30 extends around the main carrier 20, and a plurality of radially extending locating members 31 which are equi-spaced circumferentially around the guide ring 30, extend from the guide ring 30, and slideably engage an inner surface 32 of the downstream chamber 12 for slideably supporting, centrally locating and guiding the main carrier 20 in the main valve chamber 3.

Figure 2:
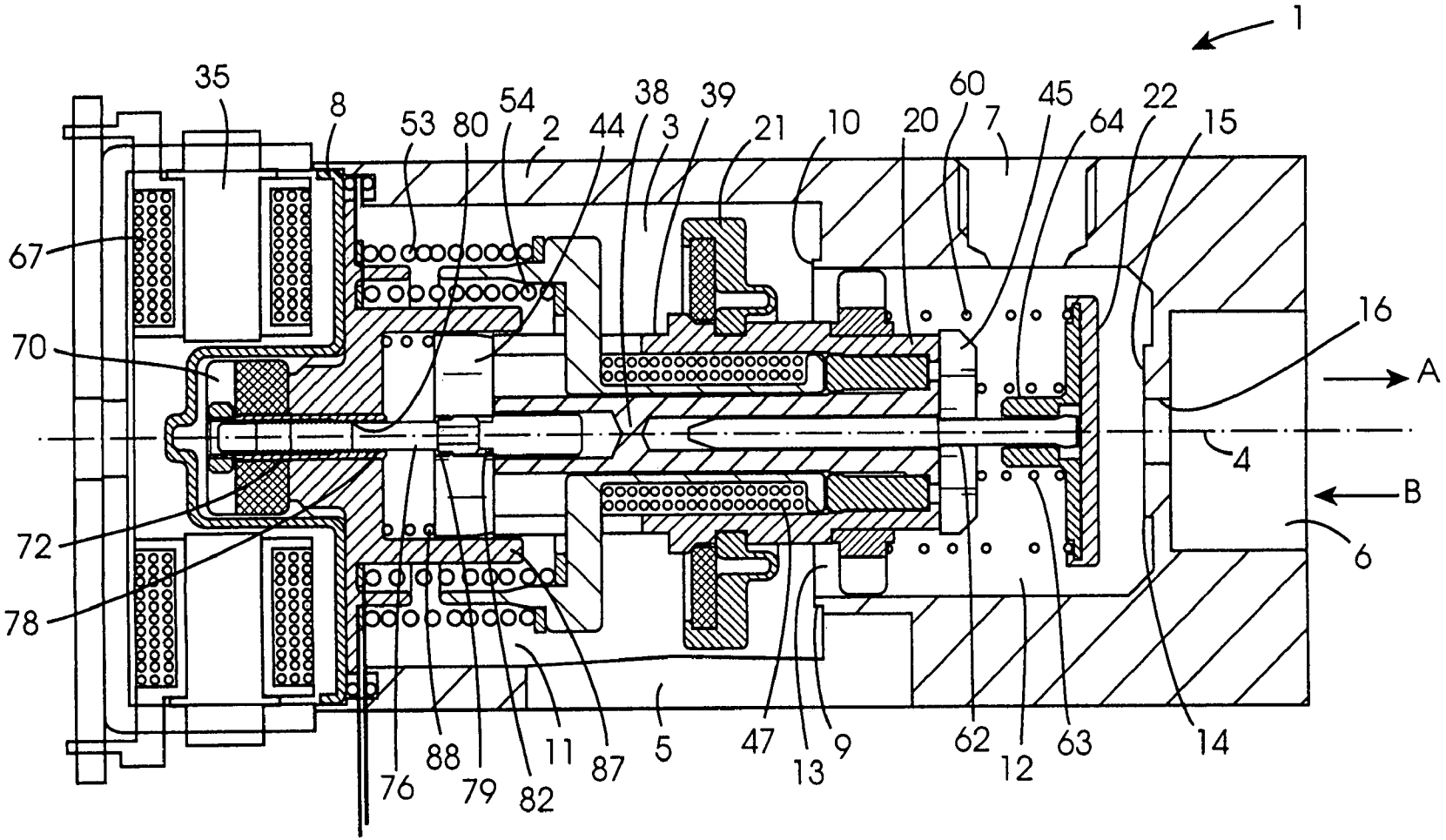
FIG. 2 is a view similar to FIG. 1 of the valve of FIG. 1 illustrating portions of the valve of FIG. 1 in a different position.
Figure 12:
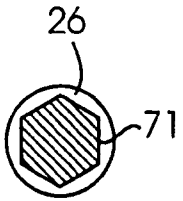
FIG. 12 is a transverse cross-sectional end elevational view of the portion of FIG. 10 on the line XII—XII of FIG. 10.
Figure 11:
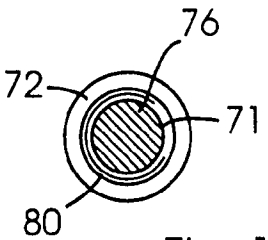
FIG. 11 is a transverse cross-sectional end elevational view of the portion of FIG. 10 on the line XI—XI of FIG. 10.
Figure 10:
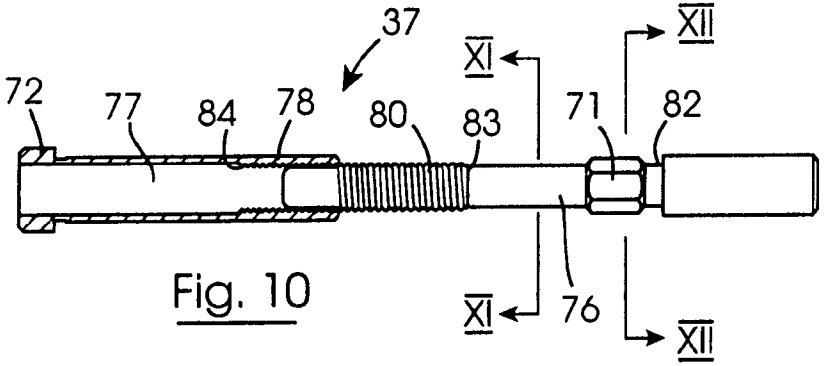
FIG. 10 is a view similar to FIG. 9 of the portion of FIG. 9 in a different position.

A drive means comprising a stepper motor 35 drives the main carrier 20 through a drive transmission means, namely, a screw-drive transmission 37 in the direction of the arrows A and B for selectively urging the primary and secondary valving members 21 and 22 between a fully closed position, illustrated in FIG. 1, with the primary and secondary valving members 21 and 22 sealably engaging the primary and secondary valve seats 10 and 15, respectively, and a fully open position illustrated in FIG. 2 with the respective primary and secondary valving members 21 and 22 spaced apart from the primary and secondary valve seats 10 and 15, respectively, for accommodating maximum flow of fuel gas from the fluid inlet 5 to the respective main and pilot fluid outlets 6 and 7. Additionally, the stepper motor 35, as will be described below, selectively drives the main carrier 20 in the directions of the arrows A and B for selectively throttling the flow of fuel gas through the secondary fluid passageway 16 at any of an infinite number of desired throttling levels, by selectively positioning the secondary valving member 22 relative to the secondary valve seat 15, as will be described below. Before describing the transmission of drive from the stepper motor 35 to the main carrier member 20 through the screw-drive transmission 37 in further detail, the main carrier 20 and its construction will be described.

The main carrier 20 comprises a central core 38 of circular transverse cross-section and of a magnetic material, namely, steel, and an outer sleeve 39 of circular transverse cross-section, and also of a magnetic material, namely, steel extending around and concentric with the central core 38, both of which define a common central axis which coincides with the main central axis 4. The outer sleeve 39 is spaced apart from the central core 38 and defines an annular chamber 40 with the central core 38. An inner annular member 42 of non-magnetic material, namely, brass extends around the central core 38 in the annular chamber 40, and is a tight interference fit with the respective central core 38 and the outer sleeve 39 for locating the outer sleeve 39 and the central core 38 concentric with and spaced apart from each other, see FIG. 4. A primary end plate 44 of hexagonal shape and a secondary circular end plate 45 are located at respective opposite ends of the central core 38 and the outer sleeve 39. Both the primary and secondary end plates 44 and 45 are of magnetic material, namely, steel, and form with the central core 38 and the outer sleeve 39 a magnetic circuit. Apart from the primary end plate 44 and the secondary end plate 45, the central core 38 and the sleeve 39 are not magnetically connected.

An electro-magnetic coil 47 wound on a former 48 of non-magnetic material, namely, plastics material is carried on the central core 38 in the annular chamber 40. The electro-magnetic coil 47 when energised causes magnetic flux to flow through the central core 38 into the outer sleeve 39 through the respective primary and secondary end plates 44 and 45 for magnetically coupling and retaining the primary and secondary end plates 44 and 45 in engagement with the central core 38 and the outer sleeve 39. Four carrier arms 52 also of plastics material extend radially from the former 48 through corresponding longitudinally extending slots 59 in the outer sleeve 39 for carrying a pair of mutually electrically insulated, electrically conductive contact rings 50 and 51, see FIG. 6. An electrical power supply to the electro-magnetic coil 47 is provided through the contact rings 50 and 51, which are electrically connected to respective ends (not shown) of the electro-magnetic coil 47. The provision of the electrical power supply to the contact rings 50 and 51 will be described below.

A primary urging means provided by a pair of electrically conductive first primary compression springs 53 and 54 acts between the end cap 8 and the carrier arms 52 of the former 48 for urging the main carrier 20 in the direction of the arrow A for urging the primary and secondary valving members 21 and 22 into the closed position engaging the primary and secondary valve seats 10 and 15, respectively. Accordingly, in the event of an emergency, on de-energising of the electro-magnetic coil 47 the primary and secondary end plates 44 and 45 are magnetically decoupled from the central core 38 and the outer sleeve 39, and the decoupling of the primary end plate 44 from the central core 38 and the outer sleeve 39 permit the first primary compression springs 53 and 54 to rapidly urge the main carrier 20 in the direction of the arrow A for in turn urging the primary and secondary valving members 21 and 22 into the closed position.

The first primary compression springs 53 and 54 also act to supply electrical power to the electro-magnetic coil 47. The first primary compression springs 53 and 54 electrically engage the contact rings 50 and 51, respectively, and also electrically engage corresponding mutually electrically insulated, electrically conductive contact rings 55 and 56, respectively, on the end cap 8. Electrical connectors 57 and 58 extend from the contact rings 55 and 56, respectively, through the main housing 2 for supplying electrical power to the contact rings 55 and 56, and in turn to the electro-magnetic coil 47 through the first primary compression springs 53 and 54.

Returning now to the secondary valving member 22, the primary urging means also comprises a second primary compression spring 60 which acts between the guide ring 30 and the carrier disc 26 for urging the carrier disc 26 in the direction of the arrow A for in turn urging the secondary valving member 22 into the closed position in sealing engagement with the secondary valve seat 15 when the electro-magnetic coil 47 is de-energised. The bore 28 in the main carrier 20, which slideably accommodates the carrier spindle 27 of the carrier disc 26 is formed in, and is concentric with the central core 38. A central bore 62 extends through the secondary end plate 45 for slideably accommodating the carrier spindle 27 from the carrier disc 26 into the bore 28 in the central core 38, see FIGS. 4 and 5. A shoulder 61 extending around the carrier spindle 27 is engageable with the secondary end plate 45 for retaining the carrier spindle 27 within the bore 28, and in turn for retaining the carrier disc 26 secured to the main carrier 20 against the action of the second primary spring 60 when the electromagnetic coil 47 is energised. However, in the event of an emergency and the electromagnetic coil 47 is de-energised, the secondary end plate 45 is magnetically decoupled from the central core 38 and the outer sleeve 39, thereby permitting the secondary valving member 22 to be urged rapidly under the action of the second primary spring 60 into the closed position. This is in addition to the urging action provided by the first primary compression springs 53 and 54.

Figure 5:
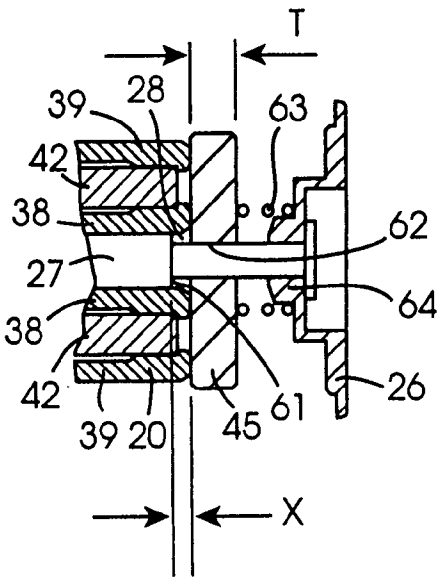
FIG. 5 is another cross-sectional side elevational view of the portion of FIG. 4 of the valve of FIG. 1.
Figure 8:
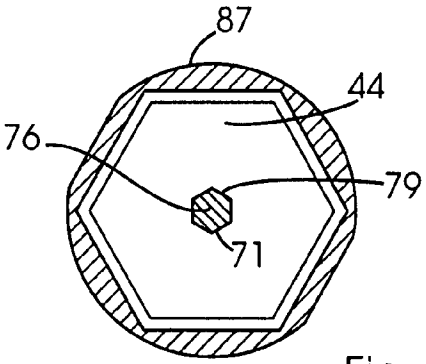
FIG. 8 is a transverse cross-sectional end elevational view of the detail of FIG. 7 on the line VIII—VIII of FIG. 7.
Figure 7:
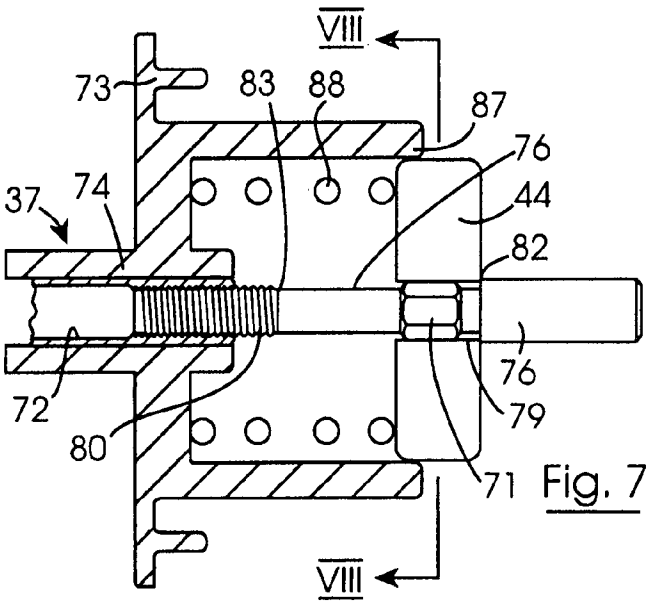
FIG. 7 is an enlarged cross-sectional side elevational view of another detail of the valve of FIG. 1.
Figure 9:
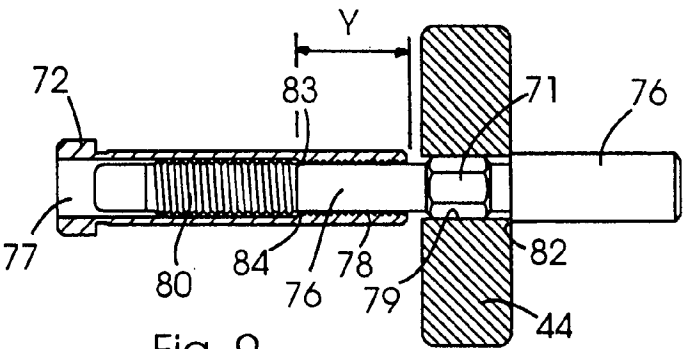
FIG. 9 is a cross-sectional side elevational view of a portion of the detail of FIG. 7.

The carrier disc 26 is moveable relative to the secondary end plate 45 a distance X, which is the distance between the shoulder 61 on the carrier spindle 27 and a shoulder 64 of the carrier disc 26 less the thickness t of the secondary end plate 45, see FIG. 5. A secondary compression spring 63 acting between the secondary end plate 45 and the carrier disc 26 urges the secondary valving member 22 into engagement with the secondary valve seat 15. Accordingly, the provision of the relative movement between the carrier disc 26 and the secondary end plate 45 together with the action of the secondary spring 63 allows the secondary valving member 22 to remain in the closed position during initial movement of the main carrier 20 from the closed position. This allows the primary valving member 21 to disengage the primary valve seat 10 before the secondary valving member 22 disengages the secondary valve seat 15. This, in turn, facilitates the provision of an initial supply of fuel gas through the primary fluid passageway 13 into the downstream chamber 12, and in turn through the pilot outlet 7 for initially supplying a pilot light jet prior to the secondary valving member 22 disengaging the secondary valve seat 15.

Returning now to the end cap 8, the end cap 8 forms the base of a secondary housing (not shown) within which part of the stepper motor 35 is housed. The stepper motor 35 comprises a rotor 70 formed by a permanent magnet, and four radially extending independently powered electromagnetic stator coils 67*a*, 67*b*, 67*c* and 67*d*, which are located around the rotor 70 to form a magnetic circuit 66. The stator coils 67 are spaced apart at 90° intervals around the rotor 70, and are mounted on the end cap 8 and located within the secondary housing (not shown). A portion 68 of the end cap 8 is shaped to form a recess 69 within which the rotor 70 is located. A hollow drive shaft 72 of the stepper motor 35 extends from the rotor 70 and is rotatably carried in a bearing 74 in a support plate 73 which is secured to the end cap 8. The rotor 70 and the drive shaft 72 are co-axial with the main central axis 4. Electrical connectors 75 extend through the secondary housing (not shown) of the end cap 8 for independently powering the coils 67 of the stepper motor 35 under the control of a control circuit 65, see FIG. 3. The control circuit 65, which is described in more detail below, selectively powers the stator coils 67 for rotating the rotor 70 of the stepper motor 35 through selected angular steps each of 90° through selected angular directions, namely, in the direction of the arrows C and D, corresponding to the directions of movement A and B, respectively, of the main carrier 20, see FIG. 3. By virtue of the fact that the stator coils 67 are independently powered, the precise angular position of the rotor 70 can be determined at all times, since the coils 67 can be powered to define alternate poles such that each pair of coils 67*a* and 67*c* on the one hand, and 67*b* and 67*d* on the other hand each determine two angular positions of the rotor 70 at 180° to each other. For example, by powering the pairs of coils in the following sequence the rotor is urged in four steps through 360° as follows:

| 0° | 90° | 180° | 360° |
|---|---|---|---|
| +67a − 67c | +67b − 67d | −67a + 67c | −67b + 67d |

The control circuit 65 comprises a microprocessor 85 which records each incremental rotation through 90° of the rotor 70 and its direction, and thus, the angular position of the rotor 70 of the stepper motor can at all times be determined knowing the polarity of the respective coils 67*a* to 67*d*.

Turning now to the screw-drive transmission 37, and referring in particular to FIGS. 7 to 12, the screw-drive transmission 37 comprises a pair of drive transmission elements, one of which is formed by the drive shaft 72, and the other by a drive spindle 76, which extends from the main carrier 20. The drive spindle 76 is co-axial with and extends into a bore 77 of the drive shaft 72. A single start internal right-hand screw thread 78 is located in the bore 77 of the drive shaft 72 and extend over a distance Y, see FIG. 9. A corresponding single start external right-hand screw thread 80 on the drive spindle 76 is engageable with the internal thread 78 in the drive shaft 72 for in turn converting the rotational drive of the drive shaft 72 in the directions of the arrows C and D into linear drive for urging the drive spindle 76, and in turn the main carrier 20, in the direction of the arrows A and B, respectively. While the electro-magnetic coil 47 is energised the drive spindle 76 is retained captive in the main carrier 20 as will be described below, and thus the rotational drive of the drive shaft 72 in the direction of the arrows C and D is translated through the drive spindle 76 into linear drive in the direction of the arrows A and B, respectively for urging the main carrier member 20 with rectilinear motion in the direction of the arrows A and B, respectively, for in turn urging the primary and secondary valving members 21 and 22 between the open and closed positions.

The drive spindle 76 is linearly slideable in a bore 79 in the primary end plate 44, and extends through the bore 79 into a central bore 81 in the central core 38, and the drive spindle 76 is also linearly slideable in the central bore 81. A main urging means comprising a main compression spring 88 acts between the primary end plate 44 and the support plate 73 for urging the primary end plate 44 into engagement with a shoulder 82 on the drive spindle 76. Thus, when the electro-magnetic coil 47 is energised and the primary end plate 44 is magnetically coupled to the central core 38 and the outer sleeve 39, the drive spindle 76 is retained captive in the main carrier 20 by the co-operating action of the primary end plate 44 and the shoulder 82 of the drive spindle 76. Additionally, the urging action of the main compression spring 88 urging the primary end plate 44 into engagement with the shoulder 82 of the drive spindle 76 positively locates the main carrier 20 relative to the drive spindle 76.

A keying means for keying the drive spindle 76 relative to the primary end plate 44, and for preventing the drive spindle 76 rotating with the drive shaft 72 is provided by a keying portion 71 of the drive spindle 76 which is of hexagonal cross-section and extends between the threaded portion 80 and the shoulder 82. The bore 79 through the primary end plate 44 is of corresponding hexagonal shape to that of the keying portion 71 of the drive spindle 76, and thus rotation of the drive spindle 76 relative to the primary end plate 44 is prevented. As discussed above, the primary end plate 44 is of hexagonal shape, and is slideably engageable in a tubular keying member 87, which also forms a part of the keying means, and which extends axially from the support plate 73 and is of hexagonal internal cross-section corresponding to the hexagonal shape of the primary end plate 44. Thus, rotation of the primary end plate 44 is prevented by the keying action of the keying member 87, and rotation of the drive spindle 76 is prevented by the keying action between the keying portion 71 of the drive spindle 76 and the primary end plate 4.

The internal and external threads 78 and 80 on the drive shaft 72 and the drive spindle 76, respectively, are arranged to act as a means for facilitating synchronizing of the stepper motor 35 with the linear position of the primary end plate 44 along the main central axis 4, and in turn the linear position of the main carrier 20 and that of the primary and secondary valving members 21 and 22. The external thread 80 on the drive spindle 76 terminates at an end location 83, and the internal thread 78 of the drive shaft 72 terminates at an end location 84. The end locations 83 and 84 of the threads 80 and 78, respectively, are matched so that when the primary end plate 44 is magnetically coupled to the central core 38 and the outer sleeve 39, the respective external and internal threads 80 and 78, respectively disengage each other at their respective end locations 83 and 84 when the main carrier 20 is in a position corresponding to the fully open position of the respective primary and secondary valving members 21 and 22. In other words, the distance between the shoulder 82 and the end location 83 of the external thread 80 of the drive spindle 76 and also the length of the internal thread 78 of the drive shaft 72 are such that when the respective external and internal threads 80 and 78, respectively, disengage at their end locations 83 and 84, the position of the primary end plate 44 corresponds to the fully open position of the primary and secondary valving members 21 and 22, respectively.

Additionally, it should be noted that irrespective of whether the central core 38 and the outer sleeve 39 are magnetically coupled or otherwise to the primary end plate 44, the action of the main compression spring 88 ensures that the primary end plate 44 will always be urged into engagement with the shoulder 82 of the drive spindle 76. Thus, the fact that the external and internal threads 80 and 78, respectively disengage each other at their end locations 83 and 84 when the position of the primary end plate 44 corresponds to the fully open position of the primary and secondary valving members 21 and 22, permits a datum condition for the stepper motor 35 to be determined corresponding to the fully open position of the primary and secondary valving members 21 and 22. The datum condition for the stepper motor 35 is thus determined when the end locations 83 and 84 of the respective threads 80 and 78 disengage each other.

The microprocessor 85 in the control circuit 65 continuously counts the number of 90° incremental rotational steps of the rotor 70, and in turn of the drive shaft 72 and their respective directions, and continuously sums the incremental 90° rotational steps adding the incremental rotational steps in the direction of the arrow C and subtracting the incremental rotational steps in the direction of the arrow D. Thus, by programming the microprocessor 85 to establish a zero datum condition for the rotor 70 of the stepper motor 35 when the external and internal threads 80 and 78 have disengaged each other at their end locations 83 and 84, and summing the incremental 90° rotational steps in the direction of the arrow C from the time the rotor 70 commences to rotate in the direction of the arrow C on re-engagement of the end locations 83 and 84 of the threads 80 and 78 and subtracting the incremental 90° rotational steps in the direction of the arrow D, the absolute position of the drive spindle 76 relative to the drive shaft 72, and in turn the absolute position of the main carrier 20 and the primary and secondary valving members 21 and 22 between the fully opened and the fully closed positions can be immediately determined by the microprocessor 85.

It should be noted that the action of the main compression spring 88 on the primary end plate 44 acts to urge the external and internal threads 80 and 78 at their end locations 83 and 84 into engagement with each other after they have disengaged. Thus, immediately upon rotation of the rotor 70 of the stepper motor 35 in the direction of the arrow C the respective external and internal threads 80 and 78 immediately commence to re-engage.

Thus, by adding each of the incremental 90° rotational steps of the stepper motor of the rotor 70 in the direction of the arrow C and subtracting the incremental 90° rotational steps of the rotor 70 in the direction of the arrow D after the stepper motor 35 has been operated to rotate the rotor 70 in the direction of the arrow C for re-engaging the respective external and internal threads 80 and 78, the absolute position of the drive spindle 76 and in turn the main carrier 20 can be determined by the microprocessor 85.

Since in this embodiment of the invention the internal and external threads 78 and 80, respectively, are single start threads, for every incremental 90° rotational step of the rotor 70 of the stepper motor 35 the drive spindle 78 is moved through a linear distance equal to one quarter of the pitch of the threads 78 and 80. Thus, while the primary end plate 44 is magnetically coupled to the central core 38 and the outer sleeve 39 each incremental 90° rotational step of the rotor 70 of the stepper motor 35 urges the main carrier member 20, and in turn the primary and secondary valving members 21 and 22 through one quarter of the pitch of the respective threads 78 and 80.

Figure 3:
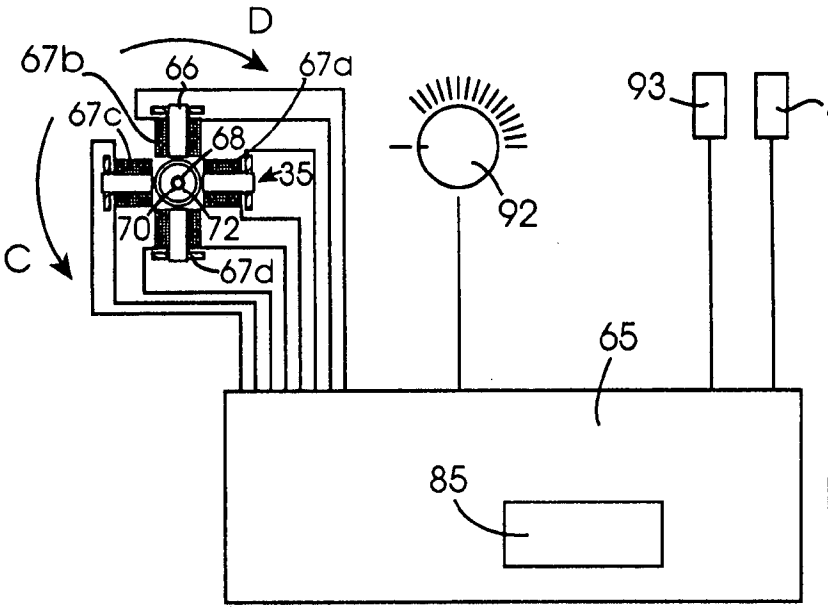
FIG. 3 is an end view of a portion of the valve of FIG. 1 in conjunction with a block representation of an electrical circuit of the valve.

An input means, typically, a control knob 92, see FIG. 3, which would typically operate a rheostat (not shown) is provided for selecting a desired setting of the main carrier 20, and in turn the primary and secondary valving members 21 and 22 for providing a desired flow rate of fuel gas through the valve 1. The output from the rheostat (not shown) operated by the control knob 32 is fed to the control circuit 65 which in turn is read by the microprocessor 85 for operating the stepper motor 35 for urging the main carrier 20 to the appropriate absolute position within the valve chamber 3. A flame sensor 93 is provided for locating adjacent a pilot light of a burner for detecting the presence or absence of a flame from the pilot light jet. The output of the flame sensor 93 is fed to the control circuit 65 and in turn is read by the microprocessor 85. The microprocessor 85 is programmed to de-energise the electromagnetic coil 47 in the event of the signal read from the flame sensor 93 indicating the failure of the pilot light flame so that the primary and secondary valving members 21 and 22 are immediately urged into the closed positions by the primary compression springs 53 and 54, and the secondary compression spring 60.

An O-ring seal 90 seals the end cap 8 to the main housing 2 for providing a gas tight seal between the end cap 8 and the main housing 2. By virtue of the fact that the rotor 70 of the stepper motor 35 is located in the recess 69 formed in the end cap 8, the rotor 70, and in turn the drive transmission 37 to the main carrier 20 are located within the valve chamber 3, thus, once the O-ring seal 90 forms a gas tight seal between the end cap 8 and the main housing 2, no further seals are required in the valve 1. In particular no dynamic seals are required in the valve 1 for sealing rotatable or slideable shafts.

In use, when the electromagnetic coil 47 is energised, and the primary and secondary end plates 44 and 45 are magnetically coupled to the central core 38 and the outer sleeve 39 by the magnetic flux generated by the electromagnetic core 47, and the stepper motor 35 and the main carrier 20 are synchronized, the valve 1 is operable between the fully open position and the closed position by the control knob 92. In the fully closed position the primary and secondary valving members 21 and 22 sealably engage the primary and secondary valve seats 10 and 15, respectively. As the rotor 70 of the stepper motor 35 is rotated under the control of the microprocessor 85 in the direction of the arrow D for urging the main carrier 20 in the direction of the arrow B, the primary valving member 21 initially disengages the primary valve seat 10 for providing a fuel gas supply through the pilot outlet 7. Further movement of the main carrier 20 in the direction of the arrow B by the rotation of the rotor 70 in the direction of the arrow D urges the primary valving member 21 further away from the primary valve seat 10, and in turn causes the secondary valving member 22 to disengage the secondary valve seat 15, thus supplying fuel gas through the main outlet 6. Under the control of the microprocessor 85 the stepper motor 35 is operated for rotating the rotor 70 in the direction of the arrow D until the main carrier 20 takes up the appropriate position corresponding to that selected by the control knob 92, so that the fuel gas is supplied through the valve 1 at the desired flow rate. Should an alternative desired flow rate be required, the control knob 92 is appropriately operated, thus causing the microprocessor 85 to operate the stepper motor 35 for repositioning the main carrier 20. Should an increase in fuel gas flow rate be required, the microprocessor 35 operates the stepper motor for rotating the rotor 70 in the direction of the arrow D. Alternatively, should a reduced fuel gas flow rate be desired, the microprocessor 85 operates the stepper motor 35 for rotating the rotor 70 in the direction of the arrow C. When it is desired to close off the supply of fuel gas through the valve 1 the control knob 92 is appropriately operated and the microprocessor 85 operates the stepper motor 35 for rotating the rotor 70 in the direction of the arrow C for urging the main carrier 20 in the direction of the arrow A until the primary and secondary valving members 21 and 22 are in the closed position sealably engaging the primary and secondary valve seats 10 and 15, respectively.

If during operation of the valve 1 when fuel gas is being supplied through the valve 1 an emergency arises, such as, for example, the flame sensor 93 determining the absence of the pilot light, the microprocessor 85 in response to the appropriate signal from the flame sensor 93 immediately de-energises the electromagnetic coil 47 for in turn permitting the main carrier 20, and in turn the primary and secondary valving members 21 and 22 to be urged into the closed position by the first primary compression springs 53 and 54 and the second primary compression spring 60.

In the event that the electro-magnetic coil 47 is de-energised, the stepper motor 35 has to be resynchronized with the main carrier 20. On de-energising of the electromagnetic coil 47 the microprocessor 85 is reset, and on being reset is programmed to operate the stepper motor 35 for rotating the rotor 70 through a number of incremental 90° rotational steps in the direction of the arrow D, which is greater than the number of such steps required for urging the main carrier 20 from the closed position to the fully open position. This, thus, thereby ensures that the respective threads 78 and 80 disengage each other, and the primary end plate 44 is in a position corresponding to the fully open position of the main carrier 20. This, thus establishes the datum condition for the stepper motor 35 corresponding to the fully open position of the main carrier 20. When it is next desired to operate the valve 1 into an open position to supply fuel gas at a desired rate, the control knob 92 is set to the desired setting. This causes the microprocessor 85 to operate the stepper motor 35 to rotate the rotor 70 through an appropriate number of rotational steps for urging the primary end plate 44 into the position corresponding to the closed position of the main carrier 20, for in turn engaging the primary end plate 44 with the central core 38 and the outer sleeve 39. The secondary end plate 45 will already be in engagement with the central core 38 and the outer sleeve 39 due to the action of the first primary springs 53 and 54, and thus, the microprocessor 85 re-energises the electromagnetic coil 47, thereby magnetically coupling the primary and secondary end plates 44 and 45 with the central core 38 and the outer sleeve 39. Thereafter the microprocessor 85 operates the stepper motor for rotating the stepper motor 35 for rotating the rotor 70 in the direction of the arrow D an appropriate number of rotational steps for in turn urging the main carrier 20 to the appropriate position for providing the flow of fuel gas through the valve 1 at the desired flow rate. Thereafter operation of the valve 1 is as already described.

Alternatively, to re-establish a datum condition for the stepper motor 35 after de-energising of the electromagnetic coil 47, the microprocessor 85 may be programmed for initially operating the stepper motor 35 for rotating the rotor 70 through an appropriate number of rotational steps in the direction of the arrow C for urging the primary end plate 44 into engagement with the central core 38 and the outer sleeve 39 of the main carrier 20 in the closed position. The electro-magnetic coil 47 would then be re-energised. The microprocessor 85 would also be programmed for then operating the stepper motor 35 to rotate the rotor 70 through a sufficient number of rotational steps in the direction of the arrow D to ensure that the respective threads 80 and 78 of the drive spindle 76 and the drive shaft 72 had disengaged at their end locations 83 and 84, respectively. At that stage the datum condition of the stepper motor would be re-established, and operation of the valve 1 would then continue as already described.

Figure 13:
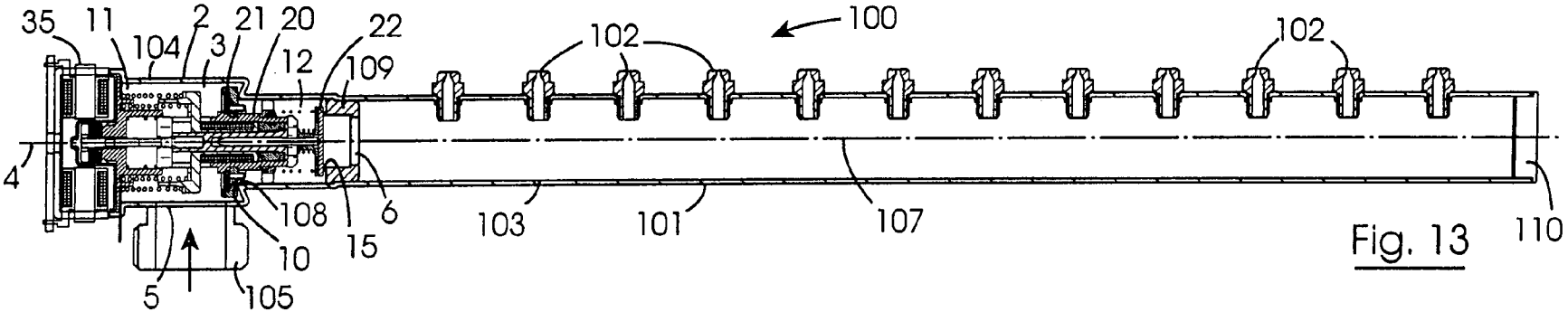
FIG. 13 is a transverse cross-sectional side elevational view of a gas burner according to the invention.
Figure 14:
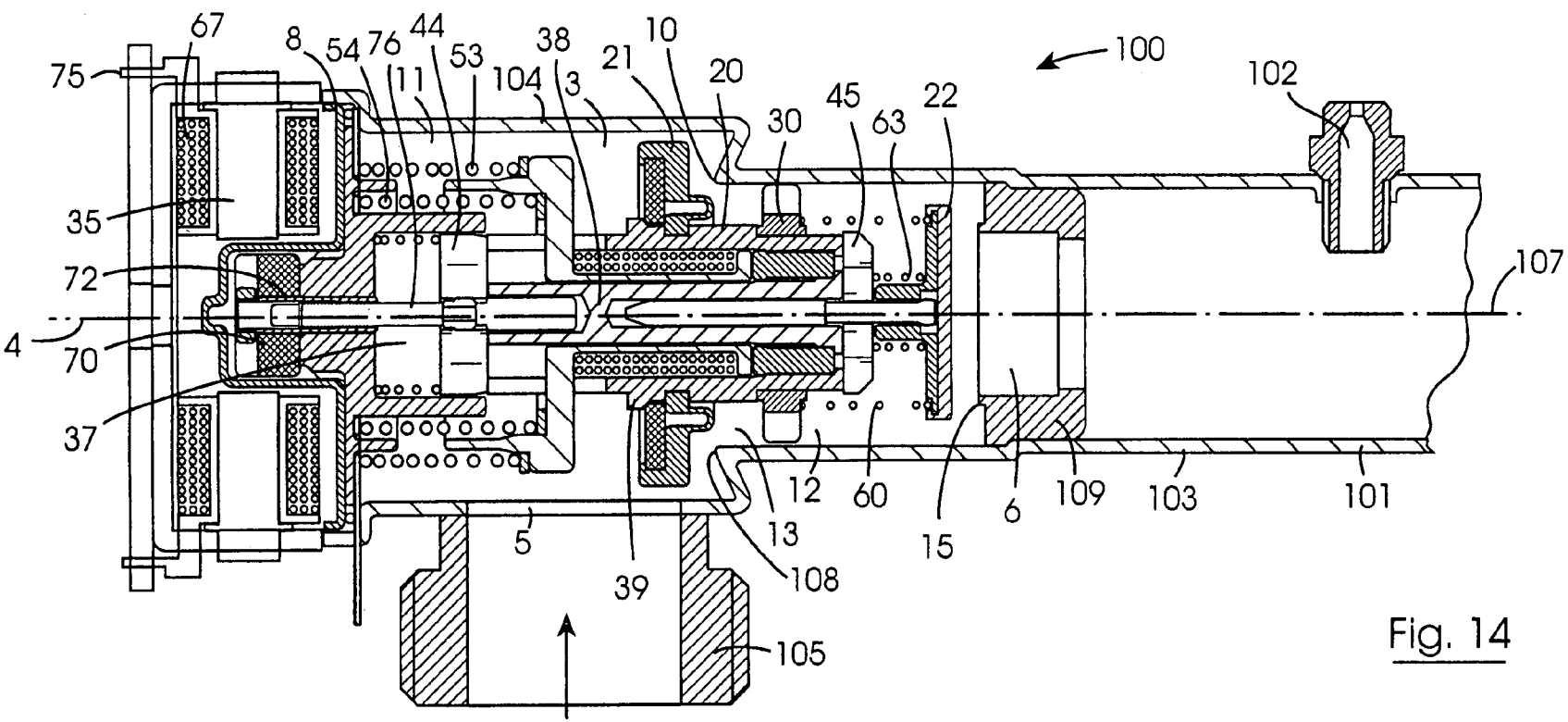
FIG. 14 is an enlarged transverse cross-sectional side elevational view of a portion of the gas burner of FIG. 13 illustrating a portion of a valve of the gas burner in a different position.

Referring now to FIGS. 13 and 14, there is illustrated a gas burner fuel gas supply line according to the invention, indicated generally by the reference numeral 100, which is particularly suitable for firing a gas fired boiler. The gas burner 100 comprises an elongated tubular manifold 101 formed by a manifold housing 103 of circular transverse cross-section. A plurality of jet outlet ports, namely, injectors 102 are located at spaced apart intervals longitudinally along the manifold housing for discharging fuel gas for combustion. The manifold 101 terminates at its upstream end in a valve which is identical to the valve 1 of FIGS. 1 to 12, and similar components are identified by the same reference numerals. In this embodiment of the invention the main housing 2 of the valve 1 is formed by a portion 104 of the manifold housing 103 at the downstream end thereof. The fluid inlet 5 is formed in the portion 104 forming the main housing 2, and an inlet port 105 extends from the fluid inlet 5 for connection to a fuel gas supply. The pilot outlet 7 is not illustrated, however, the pilot outlet 7 is provided by a pilot outlet port (not shown) through the portion 104 of the manifold housing 103. A pipe connection (not shown) connects the pilot outlet port (not shown) to a pilot jet (not shown) of the burner.

In this embodiment of the invention the manifold housing 103 and the portion 104 forming the main housing of the valve 1 are formed integrally in one piece from a single elongated tubular member typically of copper which is appropriately shaped by turning. The manifold 101 as discussed above is of circular transverse cross-section and defines a main central axis 107 which coincides with the main central axis 4 of the valve 1. The end cap 8 of the valve 1 is sealably secured to the portion 104 of the manifold housing 103 by the O-ring seal 90. The housing 104 is shaped at 108 for forming the primary valve seat 10, and a circular member 109 which is located in and retained in the manifold housing 103 between the manifold housing 103 and the portion 104 by crimping forms the secondary valve seat 15. An end cap 110 sealably closes the manifold housing 103.

Operation of the valve 1 in the manifold 100 is similar to that already described with reference to the valve 1 illustrated in FIGS. 1 to 12.

The main advantage of the gas burner 100 is the fact that the manifold housing 103 of the manifold 101 and the portion 104 forming the main housing 2 of the valve 1 are formed as one single integral unit so that no seals or connections are required between the main housing 2 of the valve 1 and the manifold 101 itself. Indeed, since the end cap 8 sealably engages the portion 104 of the manifold housing 103 for sealing the valve chamber 3, once the seal between the end cap 8 and the portion 104 is gas tight there is no danger of gas leaking from the manifold 101. Indeed, if desired and if a pilot light jet were not required, the pilot outlet 7 could be omitted.

While the manifold housing 103 and the portion 104 of the manifold 101 which forms the housing 2 of the valve 1 have been described as being formed by a singular tubular member, the manifold 101 and the housing 2 of the valve 1 could be formed by machining an appropriately shaped tubular member. While for convenience of manufacturing it is desirable that the manifold and the valve be located aligned and co-axial with each other, this is not essential. In certain cases, it is envisaged that the manifold may extend from the valve at an angle, for example, an angle of 90°, and in which case, it is envisaged that the manifold housing and the valve would be fabricated. Although in certain cases, it is envisaged that where the manifold housing and the portion 104 which forms the valve housing are formed from a tubular member, for example, a tubular member of copper, the tubular member may be bent intermediate the manifold housing and the valve housing for setting the manifold housing at the desired angle relative to the main axis 4 of the valve.

Figure 17:
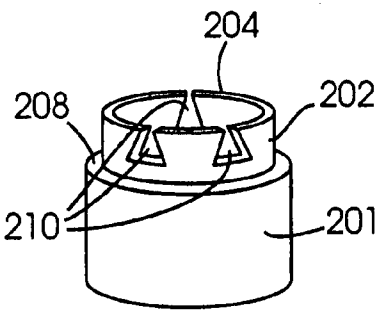
FIG. 17 is a perspective view of a portion of the valve of FIG. 15.
Figure 6:
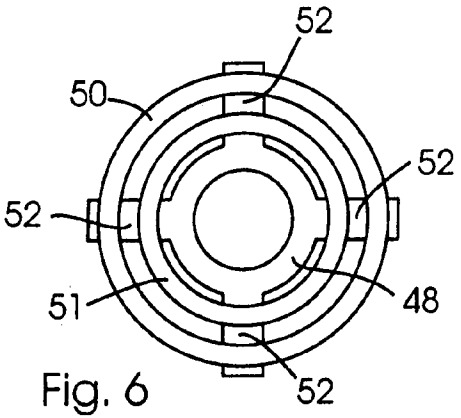
FIG. 6 is an end view of a detail of the valve of FIG. 1.
Figure 4:
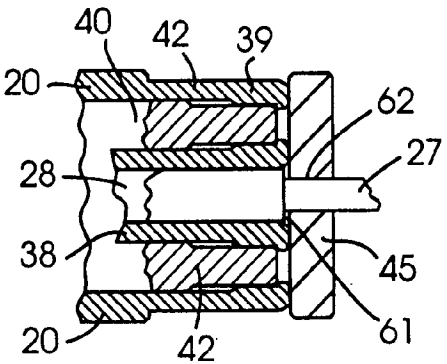
FIG. 4 is an enlarged cross-sectional side elevational view of a portion of the valve of FIG. 1.
Figure 15:
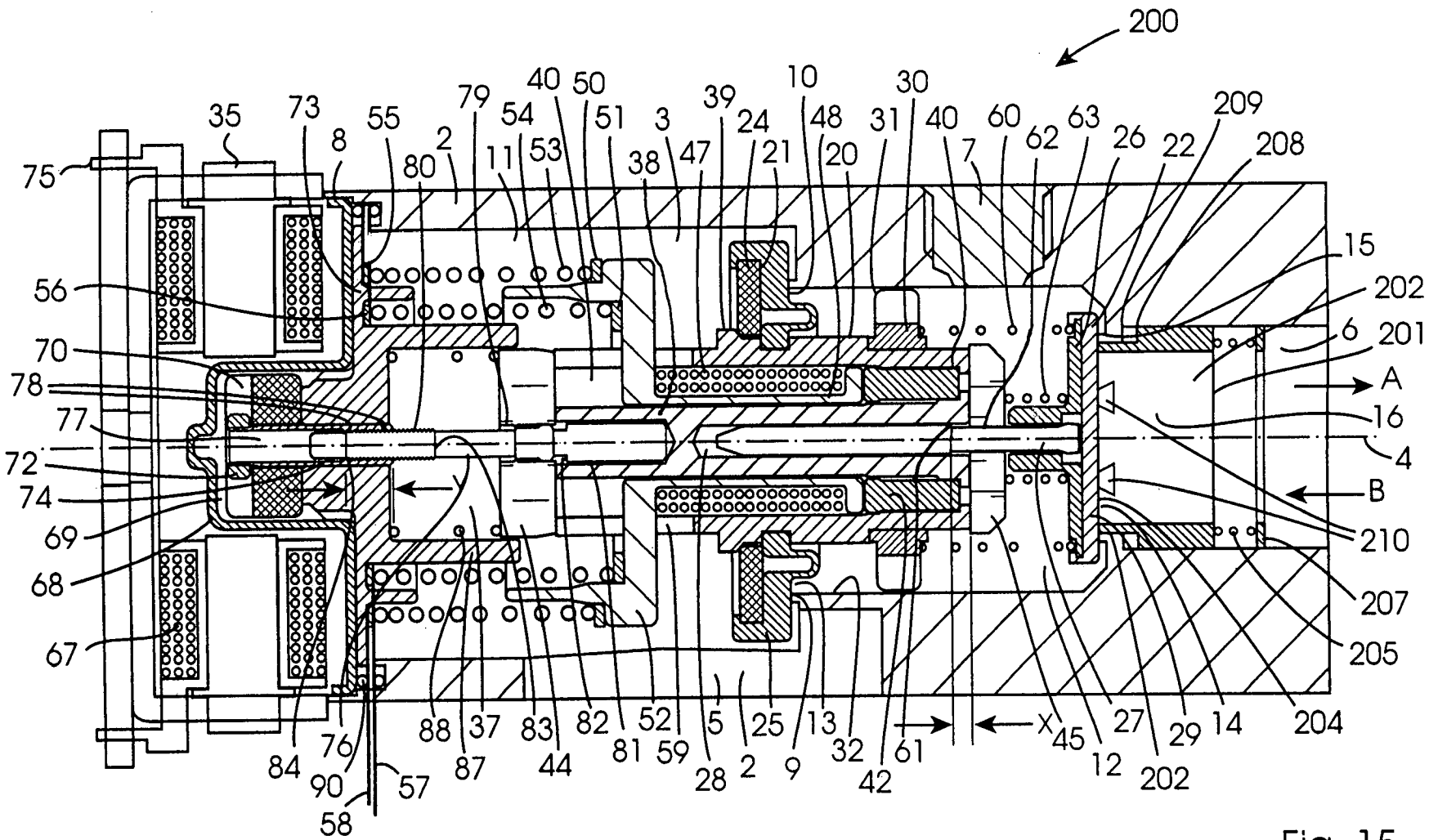
FIG. 15 is a view similar to FIG. 1 of a valve according to another embodiment of the invention.
Figure 16:
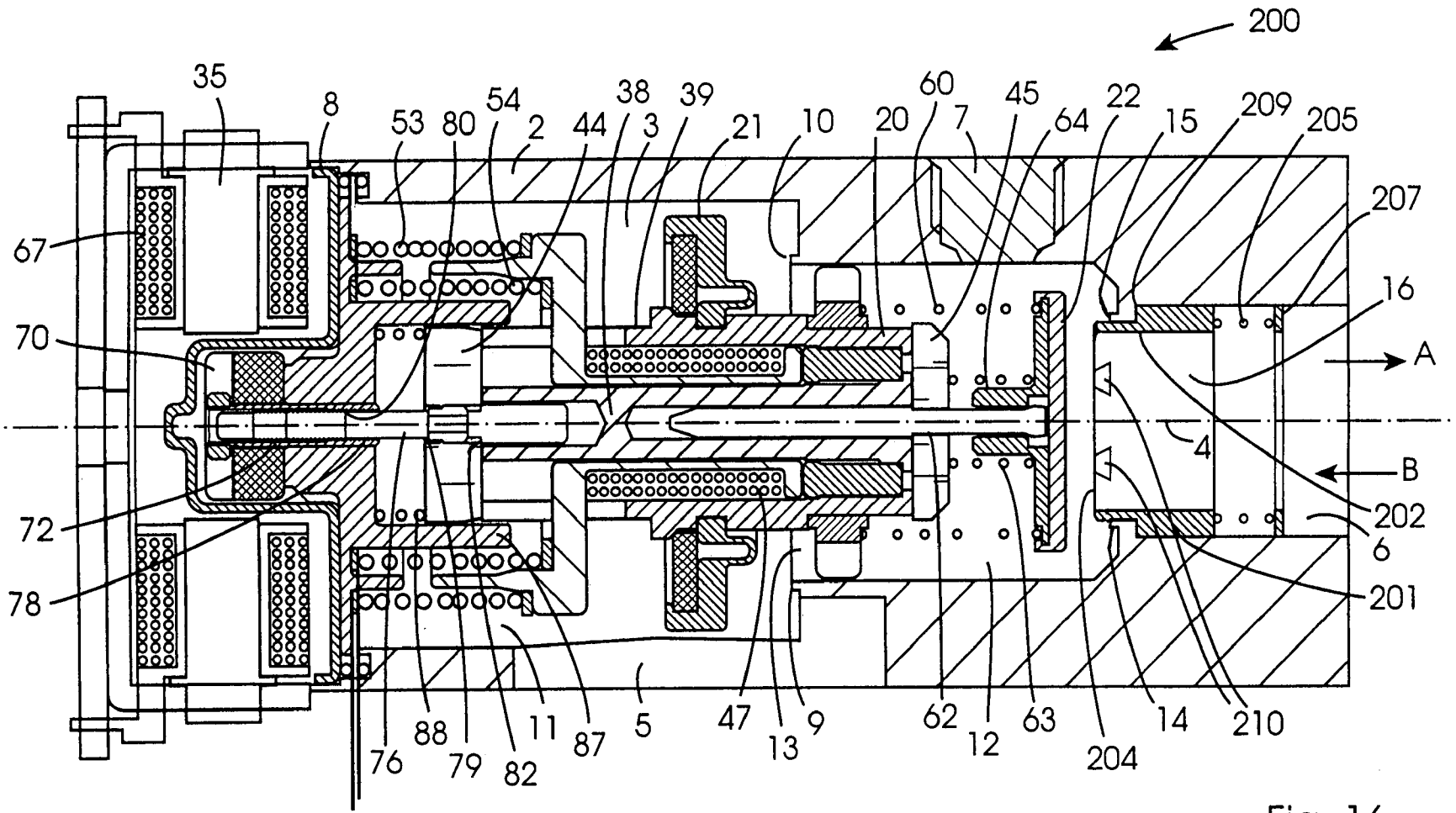
FIG. 16 is a view similar to FIG. 2 of the valve of FIG. 15.

Referring now to FIGS. 15 to 17 there is illustrated a valve according to another embodiment of the invention indicated generally by the reference numeral 200. The valve 200 is substantially similar to the valve 1 of FIGS. 1 to 12, and similar components are identified by the same reference numerals. The main difference between the valve 200 and the valve 1 relates to the secondary fluid passageway 16 and the secondary valve seat 15. In this embodiment of the invention an intermediate valve member 201 of annular shape having a cylindrical side wall 202 is sealably and slideably mounted in the secondary fluid passageway 16, and is engageable with the secondary valving member 22 when the secondary valving member 22 is in close proximity to the secondary valve seat 15. The intermediate valve member 201 co-operates with the secondary valving member 22 for controlling the flow rate of fuel gas through the valve 200 more precisely when the secondary valving member 22 is in close proximity to the secondary valve seat 15, than would otherwise be achieved by the valve 1.

The side wall 202 of the intermediate valve member 201 terminates in a radial abutment face 204 for engaging the secondary valving member 22. A supplementary urging means comprising a supplementary compression spring 205 acting between the intermediate valve member 201 and an annular flange 207 extending radially into the secondary fluid passageway 16 urges the intermediate valve member 201 in a direction towards the secondary valving member 22. A shoulder 208 extending externally around the intermediate valve member 201 engages a corresponding internally extending shoulder 209 in the secondary fluid passageway 16 for limiting movement of the intermediate value member 201 under the action of the supplementary spring 205 in the direction towards the secondary valving member 22.

A plurality of fluid accommodating openings provided by circumferentially spaced apart longitudinally extending fluid accommodating slots 210 extend from the abutment face 204 axially into the side wall 202. The fluid accommodating slots 210 accommodate fuel gas from the downstream chamber 12 to the secondary fluid passageway 16 when the secondary valving member 22 is in engagement with the abutment face 204 of the intermediate valve member 201. Thus, when the secondary valving member 22 is in engagement with the abutment face 204 of the intermediate valve member 201, and disengaged from the secondary valve seat 15 the fluid accommodating slots 210 accommodate fuel gas between the downstream chamber 12 and the secondary fluid passageway 16.

Additionally, the fluid accommodating slots 210 co-operate with the secondary valve seat 15 so that as the secondary valving member 22 is in engagement with the abutment face 204, and approaching or moving away from the secondary valve seat 15, the effective area of the fluid accommodating slots 210 is progressively decreased or increased for progressively decreasing or increasing the flow of fuel gas therethrough. Furthermore, the transverse width of the fluid accommodating slots 210 progressively increases from the radial abutment face 204 for further facilitating more precise progressive increasing and decreasing of the flow of fuel gas through the fluid accommodating slots 210 as the secondary valving member 22 is being urged from or into the closed position.

Otherwise, the valve 200 is similar to the valve 1, and its operation is likewise similar, with the exception that as the secondary valving member 22 is in close proximity with the secondary valve seat 15, the secondary valving member 22 commences to engage the abutment face 204 of the intermediate valve member 201. Further movement of the secondary valving member 22 towards or away from the secondary valve seat 15 while in engagement with the intermediate valve member 201 urges the intermediate valve member 201 relative to the secondary valve seat 15 in the direction of movement of the secondary valving member 22, so that the fluid accommodating slots 210 co-operate with the secondary valve seat 15 for precisely controlling the flow of fuel gas at relatively low rates through the valve 200. Once the secondary valving member 22 disengages the intermediate valve member 201, operation of the valve 200 is similar to that of the valve 1.

The advantage of the valve 200 is that the flow rate of fuel gas through the secondary passageway 16 can be precisely controlled when the secondary valving member 22 is in close proximity to the secondary valve seat 15. This is a particularly important advantage where one wishes to set the flow of fuel gas through the valve at a relatively low rate, and precisely control the flow of fuel gas at a desired relatively low flow rate.

Figure 18:
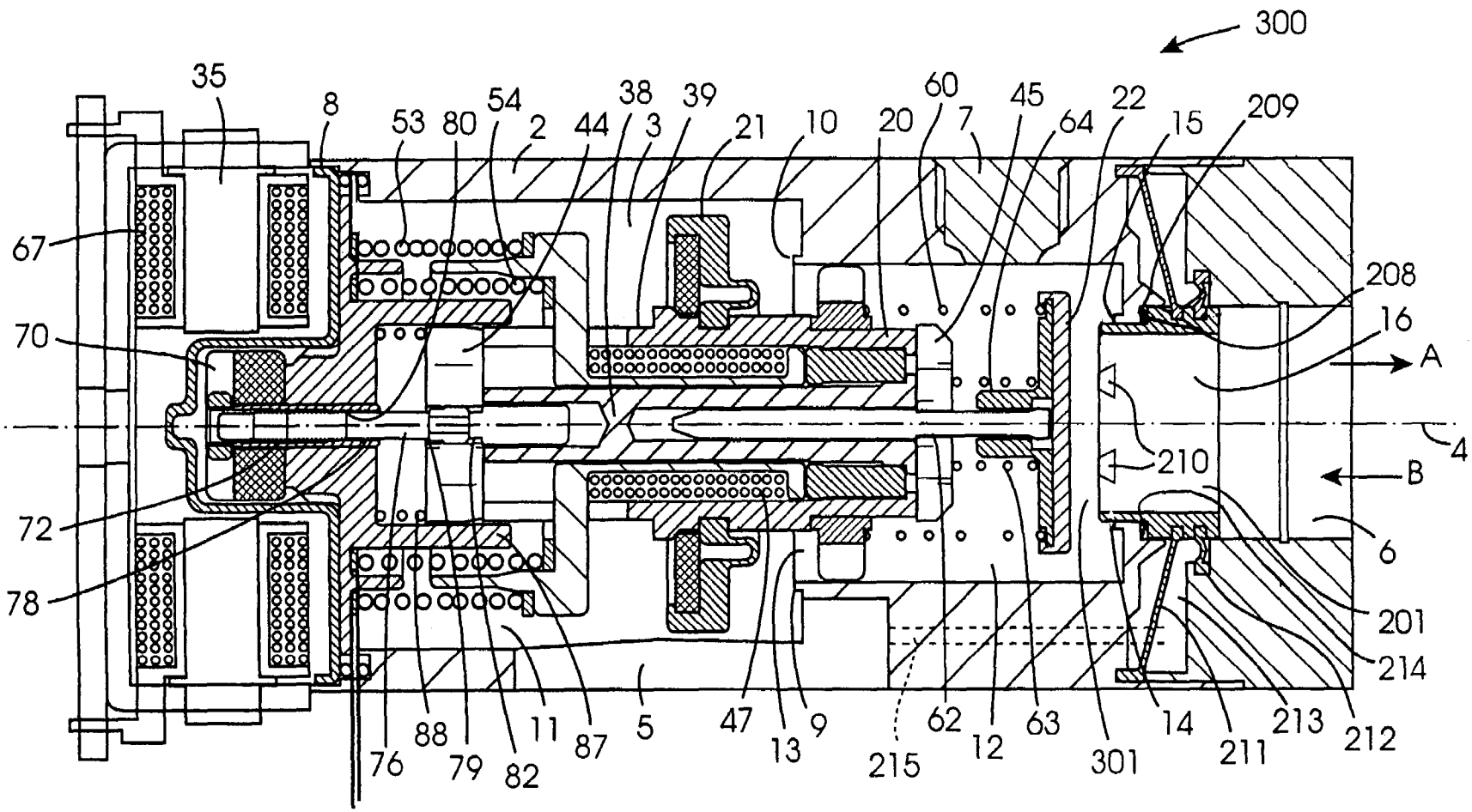
FIG. 18 is a view similar to FIG. 2 of a valve according to another embodiment of the invention.

Referring now to FIG. 18 there is illustrated a valve according to another embodiment of the invention indicated generally by the reference numeral 300. The valve 300 is substantially similar to the valves 1 and 200, and similar components are identified by the same reference numerals. The valve 300 includes an intermediate valve member similar to the intermediate valve member 201 of the valve 200, and for convenience the intermediate valve member 201 is also identified by the same reference numerals as in FIGS. 15 to 17. However, in this embodiment of the invention the intermediate valve member 201 as well as co-operating with the secondary valving member 22 for precisely and progressively increasing and decreasing the flow of fuel gas through the secondary fluid passageway 16 when the valving member 22 is in close proximity to the secondary valve seat 15, also acts to regulate the flow rate of fuel gas through the secondary fluid passageway 16 in response to fluctuation of fuel gas pressure at the inlet 5, as will be described below.

In this embodiment of the invention the intermediate valve member 201 is slideable in the secondary fluid passageway 16 as already described with reference to FIGS. 15 to 17. However, in this embodiment of the invention the intermediate valve member 201 is carried on a main membrane 211 which extends around the intermediate valve member 201 and between the intermediate valve member 201 and the main housing 2. A secondary membrane 212 also extending around the intermediate valve member 201 extends between the intermediate valve member 201 and the main housing 2. The respective main and secondary membranes 211 and 212 define with the intermediate valve member 201 and the main housing 2 a control chamber 213. An annular disc spring 214 extending between the shoulders 208 and 209 of the intermediate valve member 201 and the main housing 2 biases the intermediate valve member 201 away from the secondary valving member 22. A fluid bleed passageway 215 extends from the fluid inlet 5 to the control chamber 213 for bleeding fuel gas from the fluid inlet 5 to the control chamber 213, for maintaining the pressure in the control chamber 213 substantially similar to the fluid pressure at the fluid inlet 5.

When the secondary valving member 22 has disengaged the secondary valve seat 15 and the intermediate valve member 201, the secondary valving member 22 defines an annular opening 301 with the abutment face 204 of the intermediate valve member 201 through which fuel gas exits from the downstream valve chamber 12 to the secondary fluid passageway 16. The membranes 211 and 212 are arranged so that as the pressure in the control chamber 213 increases the intermediate valve member 201 is urged in the direction of the arrow B against the spring biasing of the annular disc spring 214 and thus towards the secondary valving member 22, for in turn reducing the area of the annular opening 301 between the secondary valving member 22 and the intermediate valve member 201. Thus, on an increase in fuel gas pressure at the fluid inlet 5, a corresponding increase in pressure results in the control chamber 213, thus urging the intermediate valve member 201 towards the secondary valving member 22, for in turn reducing the area of the annular opening 301, for in turn reducing the flow rate of fuel gas through the valve 1. Similarly, should a drop in fuel gas pressure occur at the fuel gas inlet 5, the intermediate valve member 201 is urged away from the secondary valving member 22 for increasing the area of the annular opening 301, for thus increasing the flow rate of fuel gas through the valve 300. This, thus, substantially maintains the flow of fuel gas through the valve 300 substantially constant for a given desired setting of the valve 300 irrespective of fluctuations in the fuel gas pressure at the fluid inlet 5.

In use, the valve 300 operates in substantially similar fashion to that of the valve 200. While the secondary valving member 22 is in close proximity to the secondary valve seat 15 and in engagement with the intermediate valve member 201, the intermediate valve member 201 co-operates with the secondary valve member 22 for precisely and progressively increasing and decreasing the flow of fuel gas through the secondary passageway 16, depending on whether the secondary valving member 22 is being urged away from the closed position or into the closed position as already described with reference to the valve 200 of FIGS. 15 to 17. While the intermediate valve member 201 is co-operating with the secondary valving member 22 for progressively increasing and decreasing the flow of fuel gas through the secondary fluid passageway 16 the intermediate valve member 201 is urged into engagement with the secondary valving member 22 by the action of the main and secondary membranes 211 and 212.

However, when the secondary valving member 22 is disengaged from the intermediate valve member 201, the intermediate valve member 201 acts to maintain the flow of fuel gas substantially constant through the secondary fluid passageway 16 for a given setting of the valve 300, even though the pressure of the fuel gas at the fuel gas inlet 5 may fluctuate. Should the pressure of the fuel gas at the fluid inlet 5 increase, the pressure in the control chamber 213 likewise increases, thus urging the intermediate valve member 201 towards the secondary valving member 22 for reducing the area of the annular opening 301 between the intermediate valve member 21 and the secondary valving member 22. Should the pressure of the fuel gas at the fluid inlet 5 drop, a corresponding pressure drop in the control chamber 213 allows the intermediate valve member 210 to be urged in the direction of the arrow A away from the secondary valving member 22 under the action of the disc spring 214, thereby maintaining the flow rate substantially constant through the intermediate fluid passageway 16.

Otherwise, operation of the valve 300 of FIG. 18 is similar to the valves 1 and 200 already described.

While the gas burner described with reference to FIGS. 13 and 14 has been described as comprising the valve 1, it will be appreciated that the gas burner could also be provided with the valve 200 or the valve 300. It is also envisaged that the gas burner may be provided with any other suitable type of valve besides the valves according to the invention.

While the valves according to the invention have been described for controlling the flow of fuel gas, the valves according to the invention may be used for controlling any fluid or liquid. While the valves according to the invention have been described as comprising primary and secondary valving members which co-operate with primary and secondary valve seats, respectively, it will be appreciated that the valves may be provided with a secondary valving member and a secondary valve seat only, thus, dispensing with the primary valving member and the primary valve seat. Indeed, it is envisaged that the sole valving member and the sole valve seat may actually be provided by the primary valving member and the primary valve seat if one of the valving members and valve seats were dispensed with.

While the valves according to the invention have been described as having the datum condition of the drive means set when the valving member is in the fully open position, it will be readily apparent to those skilled in the art that the datum condition of the drive means could be set when the valving member is in the fully closed position.

It is also envisaged that other drive means besides a stepper motor may be used for operating the valving member between the open and closed positions.

While the valving member has been described as being releasably coupleable to the drive means, in certain cases, it is envisaged that the valving member may not be releasably coupleable to the drive means, and it is also envisaged that where the valving member is releasably coupleable to the drive means, other suitable coupling means besides magnetic coupling may be used.

What is claimed is:

1. A valve comprising a housing (2) defining a valve chamber (3) and a valve seat (10,15) in the valve chamber (3), a fluid inlet (5) to the valve chamber (3), and a fluid outlet (6,7) from the valve chamber (3), the fluid outlet (6,7)

communicating with the fluid inlet (5) through a fluid passageway (13,16) defined by the valve seat (10,15), a valving member (21,22) co-operable with the valve seat (10,15) for throttling fluid flow through the fluid passageway (13,16), a drive means (35) coupled to the valving member (21,22) for progressively operating the valving member (21,22) between a closed position with the valving member (21,22) engaging the valve seat (10,15) for closing the fluid passageway (13,16), and a fully open position with the valving member (21,22) spaced apart from the valve seat (10,15) for opening the fluid passageway (13,16), wherein a synchronizing means (78,80,83,84) is provided for synchronizing the drive means (35) with the valving member (21,22), so that the absolute amount of throttling of the fluid through the fluid passageway (13,16) by the valving member (21,22) is directly determined by the amount of drive imparted to the valving member (21,22) by the drive means (35).

2. A valve as claimed in claim 1 in which the synchronizing means (78,80,83,84) determines a datum condition of the drive means (35) corresponding to a known position of the valving member (21,22), and the synchronizing means determines the datum condition of the drive means corresponding to the valving member being in one of the fully open position and the fully closed position, and the synchronizing means determines the datum condition of the drive means corresponding to the valving member being in the fully open position.

3. A valve as claimed in claim 1 in which the drive means (35) operates the valving member (21,22) through a drive transmission means (37), and the synchronizing means (78,80,83,84) is located in the drive transmission means (37), and the drive transmission means (37) comprises a pair of co-operating drive transmission elements (72,76), and the synchronizing means (78,80,83,84) determines the datum condition of the drive means (35) when the respective drive transmission elements (72,76) are in a predetermined relationship relative to each other corresponding to the known position of the valving member (21,22).

4. A valve as claimed in claim 3 in which the drive transmission elements co-operate with each other for converting rotational drive from the drive means to linear drive for operating the valving member with rectilinear motion between the closed position and the fully open position.

5. A valve as claimed in claim 3 in which the predetermined relationship of the respective drive transmission elements (72,76) at which the datum condition of the drive means (35) is determined is a relationship whereby the respective drive transmission elements (72,76) are disengaged one from the other.

6. A valve as claimed in claim 5 in which the disengaged condition of the respective drive transmission elements at which the datum condition of the drive means is determined is a disengaged condition in which the respective drive transmission elements are about to re-engage.

7. A valve as claimed in claim 3 in which a main urging means (88) is provided for urging the respective drive transmission elements (72,76) into re-engagement with each other when the drive transmission elements (72,76) are disengaged one from the other in the predetermined relationship, and the main urging means (88) urges the drive transmission elements (72,76) into re-engagement with each other so that when the drive means (35) commences to impart drive to one of the drive transmission elements (72,76) after the datum condition has been determined, the respective drive transmission elements (72,76) engage each other for transmitting drive to the valving member (21,22).

8. A valve as claimed in claim 3 in which one of the drive transmission elements (72,76) is a rotatably mounted drive shaft (72) which is rotatably driven by the drive means (35), the drive shaft (72) having one of an internal and an external screw thread (78,80), and the other drive transmission element (72,76) is a linearly moveable drive spindle (76) having the other of the internal and the external screw thread (78,80) co-operating with the screw thread (78,80) on the drive shaft (72) so that rotation of the drive shaft (72) in one rotational direction urges the drive spindle (76) in one linear direction, and rotation of the drive shaft (72) in the other rotational direction urges the drive spindle (76) in the opposite linear direction, and the screw threads (78,80) of the respective drive transmission elements (72,76) are disengageable when the drive spindle (76) is in a position corresponding to the valving member (21,22) being in the fully open position, and advantageously, the drive shaft (72) comprises the internal screw thread (78), and the drive means (35) comprises an electrically powered drive motor (35).

9. A valve as claimed in claim 8 in which the electrically powered drive motor is a stepper motor, and the stepper motor comprises a rotor (70) and a plurality of independently powered electro-magnetic coils (67), so that the angular position and the direction of motion of the rotor can be determined by selectively powering the coils, and advantageously, the stepper motor comprises four independently powered electro-magnetic coils located at 90° intervals around a central rotational axis of the rotor, and the drive shaft of the drive transmission means is provided by a drive shaft of the drive motor.

10. A valve as claimed in claim 1 in which the housing (2) defines a main central longitudinally extending axis (4), and the valving member is moveable axially along the main central axis (4) between the fully open and the closed position, and the rotational axis of the drive shaft coincides with the main central axis defined by the housing.

11. A valve as claimed in claim 1 in which the valving member (21,22) is releasably coupleable to the drive means (35), and a primary urging means (53,54,60) is provided for urging the valving member (21,22) into the closed position when the valving member (21,22) is decoupled from the drive means (35), and the valving member (21,22) is magnetically coupled to the drive means (35).

12. A valve as claimed in claim 1 in which an intermediate valve member (201) is located adjacent the valve seat (15) and is moveable relative thereto, the intermediate valve member (201) being engageable with and moveable with the valving member (22) during movement of the valving member (22) when the valving member (22) is moving in close proximity to the valve seat (15), and being co-operable with a portion of the housing (2) so that as the intermediate valve member (201) is engaged with and is moving with the valving member (22) the flow rate of fluid through the fluid passageway (16) is progressively altered by the co-operating action of the intermediate valve member (201) and the housing (2).

13. A valve comprising a housing (2) defining a valve chamber (3) and a valve seat (10,15) in the valve chamber (3), a fluid inlet (5) to the valve chamber (3), and a fluid outlet (6,7) from the valve chamber (3), the fluid outlet (6,7) communicating with the fluid inlet (5) through a fluid passageway (13,16) defined by the valve seat (10,15), a valving member (21,22) co-operable with the valve seat (10,15) for throttling fluid flow through the fluid passageway (13,16), a drive means (35) magnetically coupleable with the valving member (21,22) for progressively operating the valving member (21,22) when the valving member (21,22) is magnetically coupled to the drive means (35) between a closed position with the valving member (21,22) engaging the valve seat (10,15) for closing the fluid passageway (13,16), and a fully open position with the valving member (21,22) spaced apart from the valve seat (10,15) for opening the fluid passageway (13,16), a primary urging means (53, 54,60) for urging the valving member (21,22) into the closed position when the valving member (21,22) is magnetically decoupled from the drive means (35), wherein a synchronizing means (78,80,83,84) is provided for synchronizing the drive means (35) with the valving member (21,22), so that when the drive means (35) is magnetically coupled to the valving member (21,22) the absolute amount of throttling of the fluid through the fluid passageway (13,16) by the valving member (21,22) is directly determined by the amount of drive imparted to the valving member (21,22) by the drive means (35).

* * * * *